US005576819A

United States Patent [19]

Furusawa

[11] Patent Number: 5,576,819

[45] Date of Patent: Nov. 19, 1996

[54] TRANSFER ELEMENT DETECT DEVICE

[75] Inventor: Fumio Furusawa, Ebina, Japan

[73] Assignee: Fuji Xerox Co., Ltd., Tokyo, Japan

[21] Appl. No.: 543,359

[22] Filed: Oct. 16, 1995

[30] Foreign Application Priority Data

Oct. 19, 1994 [JP] Japan ..... 6-253876

[51] Int. Cl.[6] ..... G03G 15/14

[52] U.S. Cl. ..... 355/271; 355/326 R

[58] Field of Search ..... 355/271–274, 355/327, 326 R; 430/33

[56] References Cited

U.S. PATENT DOCUMENTS

| | | | |
|---|---|---|---|
| 5,185,633 | 2/1993 | Kawai et al. | 355/271 |
| 5,260,751 | 11/1993 | Inomata | 355/271 |
| 5,287,144 | 2/1994 | Takeda | 355/208 |
| 5,383,010 | 1/1995 | Sakurai | 355/271 |
| 5,406,358 | 4/1995 | Kimura et al. | 355/271 |

FOREIGN PATENT DOCUMENTS

| | | |
|---|---|---|
| 58-46366 | 3/1983 | Japan . |
| 62-185656 | 8/1987 | Japan . |

OTHER PUBLICATIONS

*Patent Abstracts of Japan,* vol. 12, No. 453 (P–792), p. 145 & JP–A–63177185, Pub. Jan. 19, 1987.

*World Patent Index Abstract,* Acc. No. 93067312[08], & U.S. Pat. 5185633, Pub. Feb. 9, 1993.

*Patents Abstracts of Japan,* (CD–ROM), Unexamined, vol. 95, No. 8 & JP–A–07209929, Aug. 11, 1995.

*Patent Abstracts of Japan,* vol. 18, No. 376 (P–1776), p. 107 & JP–A–06102722, Apr. 15, 1994.

*Patent Abstracts of Japan,* vol. 17, No. 573 (P–1630), p. 59 & JP–A–05165344, Jul. 2, 1993.

*Patent Abstracts of Japan,* vol. 13, No. 59 (P–984), p. 142 & JP–A–01252982, Oct. 9, 1989.

*Patent Abstracts of Japan* vol. 12, No. 453 (P–792), p. 145 & JP–A–63177185, Jul. 21, 1988.

*Patent Abstract of Japan,* vol. 12, No. 453 (P–792), p. 144 & JP–A–63177183, Jul. 21, 1988.

*Primary Examiner*—R. L. Moses

*Attorney, Agent, or Firm*—Oliff & Berridge

[57] ABSTRACT

A transfer element detect device which, for use in an image forming apparatus such as a copying machine, a facsimile, a laser printer and the like, can detect accurately whether a transfer element such as copying paper or the like is present at a given position of transfer element attracting means or not. A threshold value is set in accordance with a peak value Pd' on the side of the received light signal level (curved line C) of the received light signal levels (curved line D') of the light sensor when a transfer element is not attracted on transfer element attracting means. After then, in accordance with the thus set threshold value S, it is detected whether the transfer element is present on the transfer element attracting means or not.

9 Claims, 6 Drawing Sheets

TRANSFER ELEMENT DETECT DEVICE

BACKGROUND OF THE INVENTION

1. Field of the Invention

The present invention relates to a transfer element detect device which is used in image forming apparatus such as a copying machine, a facsimile, a laser printer and the like to detect whether a transfer element such as copying paper or the like is present at a given position in a transfer element attracting member or not.

2. Description of the Prior Art

Generally, in image forming apparatus such as a copying machine, a facsimile, a laser printer and the like, after a toner image is formed on a given image carrier, the toner image is transferred to the surface of a transfer element such as copying paper or the like. Normally, this transfer is executed in the following manner. That is, the transfer element is supplied onto a transfer element carrier, the transfer element is delivered to a given transfer position along with the movement of the transfer element carrier, and the toner image is transferred onto the transfer element. After then, the transfer element is delivered to a given peel-off position, where the transfer element is peeled off the transfer element carrier. If the respective operations are not performed normally, then there arise some troubles such as the jammed transfer element and the like. In order to avoid such troubles, the behavior of the transfer element on the transfer element carrier must be monitored and, as soon as anything abnormal occurs, it must be detected and a necessary countermeasure against it must be taken.

In view of the above, conventionally, there have been made a large number of proposals on a device which is used to detect whether the transfer element is present or not. For example, in Unexamined Japanese Patent Publication 58-46366, there is disclosed a jam detect device with a wound photosensitive drum which includes a light emitting element and a light receiving element and can detect the jammed transfer element in accordance with a ratio between the output obtained when the transfer element is present and the output when the transfer element is absent. Also, in Unexamined Japanese Patent Publication 62-185656, there is disclosed a device which includes a first light receiving element positioned in an area where paper is present, and a second light receiving element positioned in an area where no paper is present, and is arranged to judge that the paper is present when a level difference between the photo-electric conversion outputs of the first and second light receiving elements exceeds a given value.

In the above conventional devices, the previously determined outputs respectively obtained when the photosensitive element is detected and when the transfer element is detected are stored, and the jammed transfer element is detected based on the ratio between them; and, whether the transfer element is present or absent is judged based on both of the value of the output of a light sensor for transfer element attracting means and the output value of a light sensor for the transfer element attracting means. Therefore, when the whole surface of the transfer element attracting means is stained or is deteriorated uniformly, then the presence or absence of the transfer element can be detected effectively. However, in fact, it is quite rare for the transfer element attracting means to be stained or deteriorated uniformly. It is usual that the stain of the transfer element attracting means or the deterioration thereof due to damage or the like varies depending on the size of the transfer element, the bonding position of the transfer element to the transfer element attracting means, the size or the frequency of use of the transfer element, and the like. If the transfer element attracting means is stained or deteriorated ununiformly, then the quantity of light reflected from the transfer element attracting means not carrying the transfer element to the photosensor, or the quantity of the transmitted light thereof varies, with the result that the receiving light signal level also varies. Also, not only due to the stained or deteriorated transfer element attracting means but also due to the stained light receiving surface of the light sensor and due to the deteriorated elements thereof, the light receiving level also varies. Further, the light receiving signal level naturally varies depending on the kinds of the transfer elements. However, the prior art is not able to cope with such environmental variations, that is, according to the prior art, the judging standard for presence or absence of the transfer element is likely to be unstabilized, so that a sufficient detection effect cannot be provided.

SUMMARY OF THE INVENTION

In view of the above circumstances, the present invention aims at eliminating the drawbacks found in the above-mentioned conventional transfer element detect devices. Accordingly, it is an object of the invention to provide a transfer element detect device which can detect accurately whether a transfer element is present or not, free from influences due to the stained light receiving surface of a light sensor, the deteriorated elements, the kinds of the transfer elements, and the like.

In attaining the above object, according to a first aspect of the invention, there is provided a transfer element detect device which includes transfer element attracting means for attracting a given transfer element onto the surface thereof and is able to detect whether the given transfer element is attracted to the transfer element attracting means or not, the transfer element detect device comprising: detect means which includes a light sensor for receiving the reflected light or transmitted light of the transfer element attracting means and detects whether the transfer element is attracted to the surface of the transfer element attracting means by dividing the received light signal level of the light sensor with a given threshold value into two parts; threshold value setting means which sets the above threshold value based on the peak value on the side of the received light signal level in a given area of the surface of the transfer element attracting means obtained when the transfer element is attracted to the surface of the transfer element attracting means out of the received light signal levels of the light sensor obtained when the transfer element is not attracted to the surface of the transfer element attracting means; and, means which stores the threshold value and compares it with the received light signal level as the need arises.

Further, according to a second aspect of the invention, there is provided a transfer element detect device which includes a transfer element attracting means for attracting a given transfer element onto the surface thereof and is able to detect whether the given transfer element is attracted to the transfer element attracting means or not, the transfer element detect device comprising: detect means which includes a light sensor for receiving the reflected light or transmitted light of the transfer element attracting means and detects whether the transfer element is attracted to the surface of the transfer element attracting means by dividing the received light signal level of the light sensor with a given threshold value into two parts; threshold value setting means which sets the above threshold value based on the peak value on the side of the received light signal level obtained when the transfer element is not attracted to the surface of the transfer element attracting means out of the received light signal levels of the light sensor in a given area of the surface of the transfer element attracting means obtained when the transfer element is attracted to the surface of the transfer element attracting means; and, means which stores the threshold value and compares it with the received light signal level as the need arises.

Furthermore, according to a third aspect of the invention, there is provided a transfer element detect device which includes a transfer element attracting means for attracting a given transfer element onto the surface thereof and is able to detect whether the given transfer element is attracted to the transfer element attracting or not, the transfer element detect device comprising: detect means which includes a light sensor for receiving the reflected light or transmitted light of the transfer element attracting means and detects whether the transfer element is attracted to the surface of the transfer element attracting means by dividing the received light signal level of the light sensor with a given threshold value into two parts; threshold value setting means which sets the above threshold value based on not only a first peak value on the side of the received light signal levels obtained when the transfer element is attracted to the surface of the transfer element attracting means out of the received light signal levels of the light sensor in a given area of the surface of the transfer element attracting means obtained when the transfer element is not attracted to the surface of the transfer element attracting means, but also a second peak value on the side of the received light signal level obtained when the transfer element is not attracted to the surface of the transfer element attracting means out of the received light signal levels of the light sensor in a given area of the surface of the transfer element attracting means obtained when the transfer element is attracted to the surface of the transfer element attracting means; and, means which stores the threshold value and compares it with the received light signal level as the need arises.

Here, the above-mentioned term "transfer element attracting means which can attract a given transfer element to the surface thereof" includes not only transfer element carrying means such as a transfer drum, a transfer belt and the like which, in a normal operation, attracts a transfer element to which a toner image is transferred, but also an image carrying means such as a photosensitive drum, a photosensitive belt and the like which, in an abnormal operation, can attract the transfer element. And, the setting of the threshold value is carried out periodically before the respective image forming cycles or according to the accumulated time of use or the number of revolutions of a transfer device, and thus it can be easily adapted to variations in the transfer element attracting means as well as variations in the transfer element.

In the first transfer element detect device according to the invention, since the threshold value for judging whether the transfer element is attracted to the surface of the transfer element attracting means can be properly set according to cases based on the peak value on the side of the received light signal levels obtained when the transfer element is attracted to the surface of the transfer element attracting means out of the received light signal levels of the light sensor in a given area of the surface of the transfer element attracting means obtained when the transfer element is not attracted to the surface of the transfer element attracting means, the optimum threshold value can be obtained under the given conditions, even if the received light signal level is caused to vary due to the ununiform stain or deterioration of the surface of the transfer element attracting means, or the stained light receiving surface of the light sensor, or the deteriorated elements.

Also, in the second transfer element detect device according to the invention, since the threshold value for judging whether the transfer element is attracted to the surface of the transfer element attracting means can be properly set according to cases based on the peak value on the side of the received light signal level obtained when the transfer element is not attracted to the surface of the transfer element attracting means out of the received light signal level of the light sensor in a given area of the surface of the transfer element attracting means obtained when the transfer element is attracted to the surface of the transfer element attracting means, the optimum threshold value can be obtained under the given conditions, even if the received light signal level is caused to vary due to a change in the kind or size of the transfer element, the stained light receiving surface of the light sensor, or the deteriorated elements.

Further, in the third transfer element detect device according to the invention, since the threshold value for judging whether the transfer element is attracted to the surface of the transfer element attracting means can be properly set according to cases based on not only a first peak value on the side of the received light signal levels obtained when the transfer element is attracted to the surface of the transfer element attracting means out of the received light signal levels of the light sensor in a given area of the surface of the transfer element attracting means obtained when the transfer element is not attracted to the surface of the transfer element attracting means, but also a second peak value on the side of the received light signal levels obtained when the transfer element is not attracted to the surface of the transfer element attracting means out of the received light signal levels of the light sensor in a given area of the surface of the transfer element attracting means obtained when the transfer element is attracted to the surface of the transfer element attracting means, the optimum threshold value can be obtained under the given conditions, even if the received light signal level is caused to vary due to a change in the kind or size of the transfer element, the stained light receiving surface of the light sensor, or the deteriorated elements.

Also, since the threshold value can be set or reset depending on the surfaces of the transfer element attracting means and transfer element before the respective image forming cycles and according to the accumulated time of use of the transfer device, the threshold value can be adapted sufficiently to the above-mentioned variations.

DETAILED DESCRIPTION OF THE PREFERRED EMBODIMENTS

Now, description will be given below in more detail of the embodiments of a transfer element detect device according to the invention with reference to the accompanying drawings.

Figure 1:
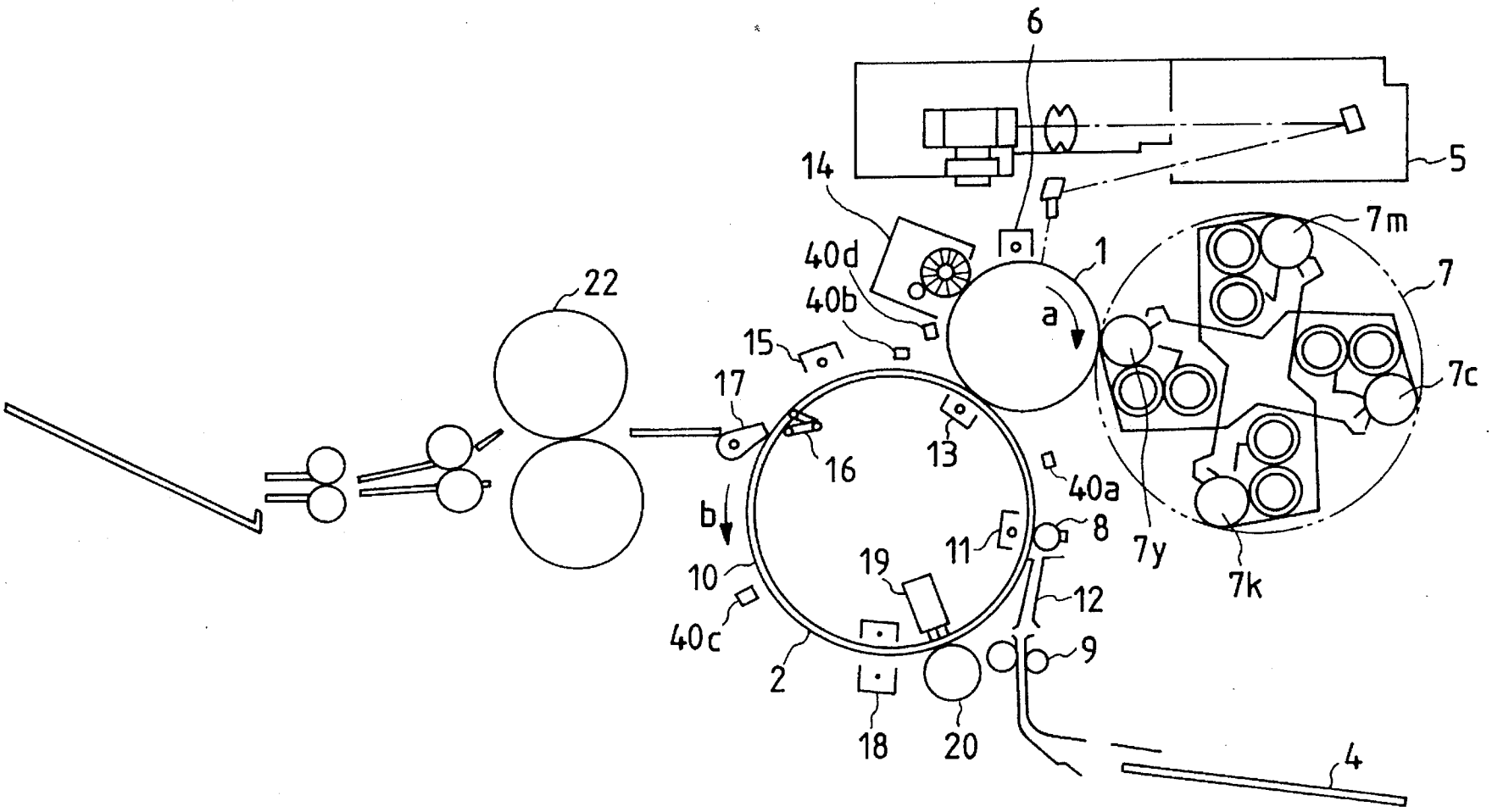
FIG. 1 is a section view of an embodiment of a transfer element detect device which is applied to a color laser printer.

FIG. 1 shows an embodiment of a transfer element detect device according to the invention which is applied to a color laser printer.

In the present embodiment, there is employed a photosensitive drum 1 which is rotated in a direction of an arrow shown in FIG. 1. After the photosensitive drum 1 is charged uniformly by a primary electric charger 6, an electrostatic latent image corresponding to an image of a given first color out of yellow, magenta, cyan and black is written into the photosensitive drum 1 by an image write device 5. Next, the electrostatic latent image is developed by a given first color developing device out of four developing devices provided in a developing apparatus 7, that is, a yellow developing device 7*y*, a magenta developing device 7*m*, a cyan developing device 7*c*, and a black developing device 7*k*, so that a toner image of the first color can be obtained.

On the other hand, a transfer element 4 is delivered through a register roller 9 and a paper chute 12, is inserted between a transfer element attracting roller 8 and a transfer element carrier 10, which are respectively provided in a transfer device 2, and is then attracted onto the transfer element carrier 10 due to the electrostatic attraction of an attracting corotron 11. After the transfer element 4 is carried by the transfer element carrier 10 in this manner, as the transfer element carrier 10 is rotated in a direction of an arrow b shown in FIG. 1, the transfer element 4 is delivered to a transfer position which is defined by the photosensitive drum 1 and transfer corotron 13. During this delivering process, whether the transfer element is present on the transfer element carrier or not is detected based on a received light signal sent from a transfer element detecting sensor 40*a* which is disposed adjacent to the transfer element carrier 10. It is checked whether this detection result is in conformity with a predetermined transfer schedule or not. If it is found yes, then the toner image of the first color formed on the photosensitive drum 1 is transferred at a given position on the transfer element 4. If no, then there is displayed on a display device a message to the effect that an abnormal condition is found, thereby causing the operation of the transfer device to stop.

After then, another electrostatic latent image, which corresponds to an image of a second color, is written onto the photosensitive drum 1 by the image write device 5. Next, this electrostatic latent image is developed by a developing device for a second color out of the four developing devices provided in the developing apparatus, thereby providing a toner image of the second color.

On the other hand, when the transfer element carrier 10 carrying thereon the transfer element 4 onto which the first color has been transferred is rotated in the arrow b direction and reaches the position of a transfer element detecting light sensor 40*b*, it is detected in accordance with the received light signal from the transfer element detecting light sensor 40*b* whether the transfer element is present on the transfer element carrier 10 or not. After then, it is checked whether this detection result is in conformity with the predetermined transfer schedule or not. If any abnormality is found, then, similarly to the above-mentioned case, a message to the effect that an abnormal condition is found is displayed on the display screen, whereby the operation of the detect device is caused to stop. If no abnormal condition is found, then the transfer element carrier 10 carrying the transfer element 4 thereon further continues to rotate and reaches the position of a transfer element detecting light sensor 40*c*. At this position as well, in accordance with the received light signal from the transfer element detecting light sensor 40*c*, it is detected whether the transfer element is present on the transfer element carrier 10 or not. And, after then, it is checked whether the detection result is in conformity with the predetermined transfer schedule or not. As the result of this check, a similar processing to the above-mentioned cases is carried out. Next, the transfer element carrier 10 carrying the transfer element 4 thereon is rotated on still further to reach the position of the transfer element detecting light sensor 40*a*, at which it is detected in accordance with the received light signal from the light sensor 40*a* whether the transfer element is present or not on the transfer element carrier 10 and, after then, it is checked whether the detection result is in conformity with the predetermined transfer schedule or not. As the result of this check, a similar processing to the above-mentioned cases is executed. After then, the transfer element carrier 10 carrying the transfer element 4 is delivered back again to a transfer position adjacent to the photosensitive drum 1, where a toner image of the second color on the photosensitive drum 1 is then transferred to a given position on the transfer element 4.

Figure 5:
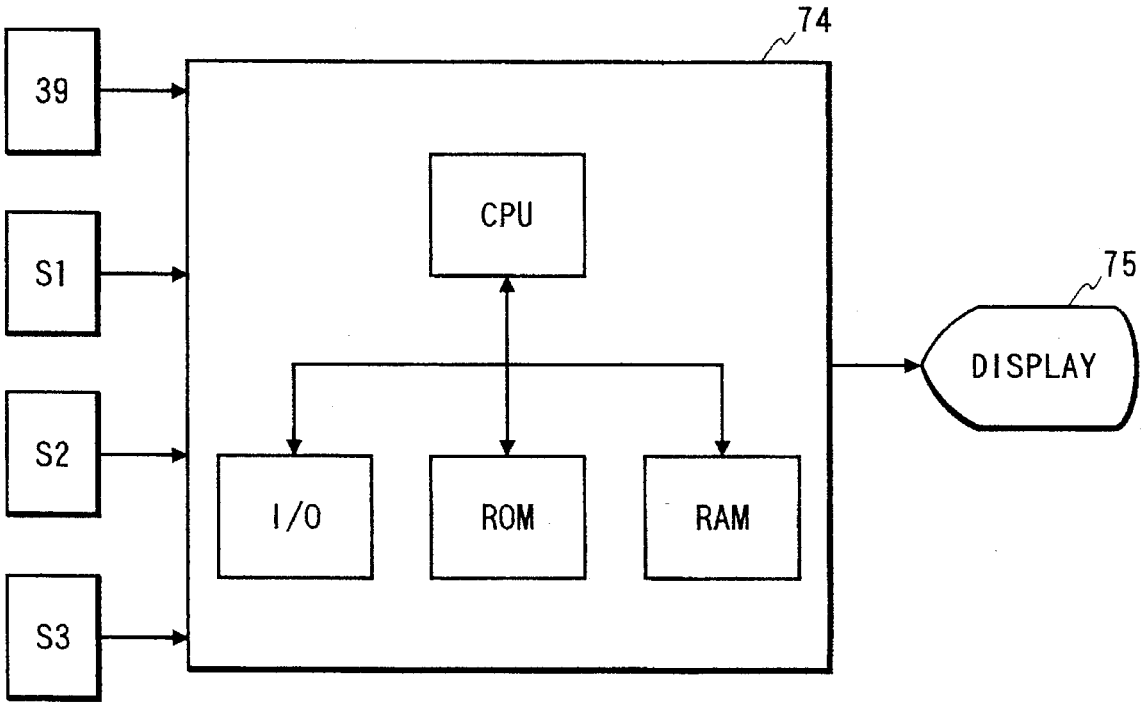
FIG. 5 is a circuit diagram of the main portions of a circuit employed in the invention.
Figure 6:
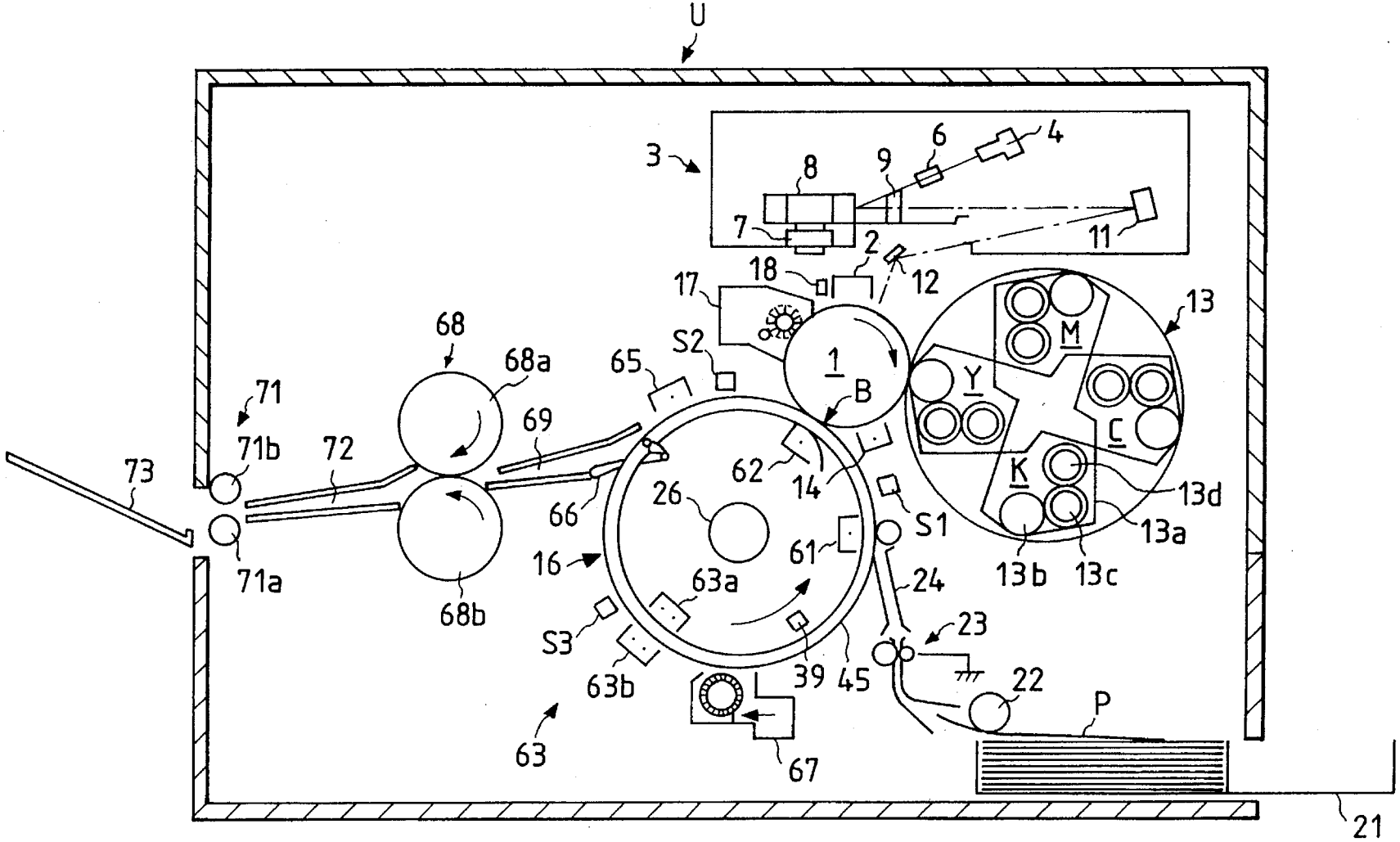
FIG. 6 is a section view of another embodiment of a transfer element detect device according to the invention.

Now, FIGS. 5 and 6 are respectively explanatory views of the main portions of a circuit part employed in the present embodiment.

The detect signals of a drum position sensor 39 and transfer element sensors S1–S3 are input in a microcomputer 74. The microcomputer 74 comprises a CPU (a central processing unit), an I/O (an input/output interface), a ROM (a read-only memory), a RAM (a random access memory), and the like.

And, the microcomputer 74 can be operated in accordance with a program which is stored in the ROM and is structure such that it can perform various functions. Also, the microcomputer 74 is structured such that it can display a given piece of information on the display part 75 of a digital printer U. When the power source of the digital printer U is put to work, then the microcomputer 74, when an image recording operation is started, executes a transfer element initial detect flow which is shown in FIG. 7.

Figure 7:
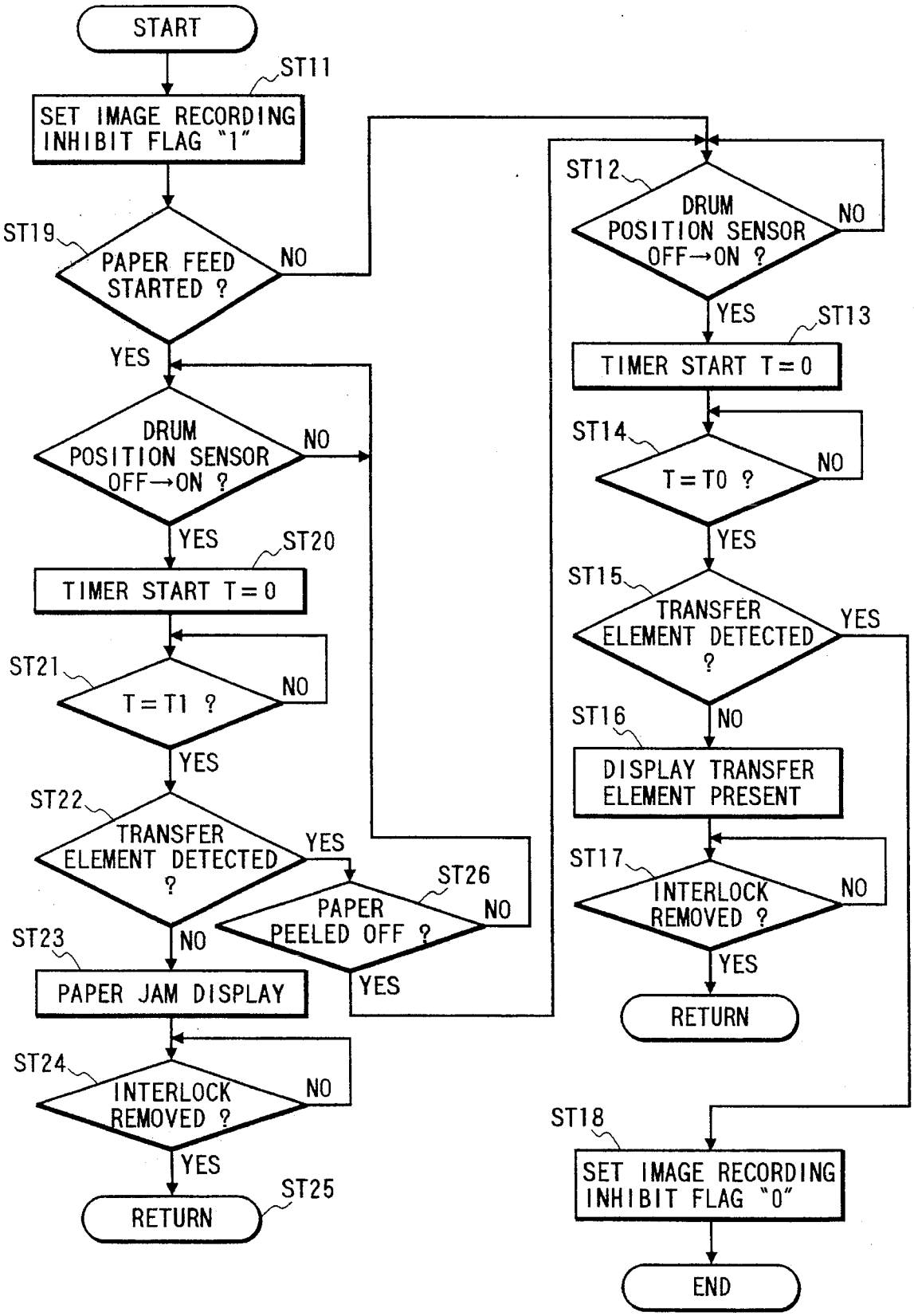
FIG. 7 is a flow chart of a transfer element initial detect flow employed in the invention.

In FIG. 7, there is shown a flow chart of the transfer element initial detect flow. That is, if the transfer element initial detect flow is started, then an image recording inhibit flag "1" is put up in Step ST11.

In Step ST19, it is detected whether paper feed is started or not and, if no (N) is found, then the processing advances to Step ST12 and, if yes (Y), then the processing is moved further to Steps ST20, 21 and 23 by the drum position sensor. And, the processing carries out a paper jam display in Step ST23, then the processing removes interlocking (in Step ST24), and finally it advances to Return (Step ST25).

Also, if the transfer element is detected in Step ST22, then it is confirmed in Step ST26 whether the transfer element is peeled off or not. This is confirmed to detect whether the paper is normally peeled off and is not left on the transfer element carrier.

Next, in Step ST12, it is checked whether the drum position sensor 39 is turned from off to on. If no (N), then the processing in Step ST12 is executed repeatedly. If yes (Y), then the processing moves to the next step ST13. Here, the time when yes (Y) is found is a time $t_0$ shown in FIG. 13.

Next, in Step ST13, the measuring time of a timer is set for T=0 and, after then, the timer is put into operation.

Then, in Step ST14, it is checked whether $T=T_0$ or not. If no (N), then Step ST14 is executed repeatedly. If yes (Y), then the processing moves to the next step ST15. In Step ST15, it is checked whether the transfer element sensor $S_1$ is on or not. If yes (Y), then there is displayed in Step ST16 a message that the transfer element is present. This disables a copy start button from being accepted.

Next, in Step ST17, it is checked whether interlock is removed or not. If no (N), then the processing in Step ST16 is executed repeatedly. If a user opens the door or cover of the image forming device U, removes the jammed transfer element P, and closes again the door or cover of the device U, then the interlock can be removed by the switch that is turned on or off in linking with the user's operation. If yes (Y) is found in Step ST17, then the transfer element detect flow is started at the beginning.

If no (N) is found in the above-mentioned step ST15, then the transfer element P is absent there and, therefore, in Step ST18, the image inhibit flag F is set for "0" to thereby end the transfer element initial detect flow.

Next, similarly to the case of the second color, for a third color and a fourth color, image writing, development and transfer are executed to thereby complete a color image in which the four color toner images are multi-transferred. In the above embodiment, description has been given of the processings on the four colors but, however, the number of colors to be processed can also be limited to a desired number.

When the transfer element 4 having the four color toner images transferred thereon reaches the position of the transfer element detecting light sensor **40*b*, similarly to the above-mentioned case, based on the received light signal from the transfer element detecting sensor 40*b*, it is detected whether the transfer element is present on the transfer element carrier 10 or not. And, it is checked whether the detection result is in conformity with a predetermined transfer schedule or not and, if any abnormal condition is found, then there is displayed a message to the effect that an abnormal condition is found, thereby causing the operation of the device to stop. If no abnormal condition is found, then the transfer element 4 is adjusted in potential by a peel-off corotron 15, is then peeled off the transfer element carrier 10 by a peel-off claw 17 with or without the aid of a peel-off auxiliary internal push roller 16, and is finally fixed by fixing device 22**.

On the other hand, the transfer element carrier 10, from which the transfer element 4 has been peeled, reaches the position of the transfer element detecting light sensor **40*c*, where it is detected in accordance with the received light signal from the light sensor 40*c* whether the transfer element is present on the transfer element carrier 10 or not. If a normal operation has been performed, then the transfer element ought not to be present there at this time. However, some abnormal conditions can occur, for example, the transfer element has not been peeled off the transfer attracting means, or, two sheets of transfer elements have been supplied and one of them has been peeled off whereas the other had not been peeled off. In such case, there is displayed a message telling that an abnormal condition is found, thereby causing the operation of the transfer device to stop. If no abnormal condition is found, then the electric energy is removed from the transfer element carrier 10 by an electricity removing corotron 18, the transfer element carrier 10 is cleaned by a transfer element carrier cleaner 20 and a brush 19 provided within the cleaner, and is then delivered again to the position of the transfer element attracting roller 8, where a new transfer element is supplied to the transfer element carrier 10**.

And, just in front of a photosensitive drum cleaner 14 of the photosensitive drum 1, there is also provided a transfer element detecting light sensor **40*d* which is used to detect an abnormal condition as quickly as possible that the transfer element is wound around the photosensitive drum 1 for some reason whereas the transfer element ought to have been attracted to and delivered by the transfer element carrier 10**.

Figure 2:
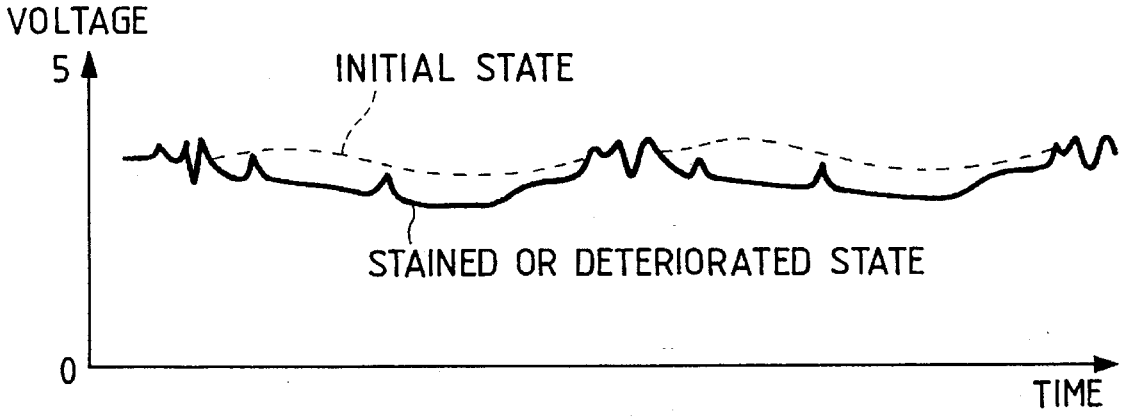
FIG. 2 is a graphical representation of variations in a received light signal obtained when a transfer element is not attracted on transfer element attracting means.

Now, FIG. 2 shows an example of a graphical representation in which the received light signal from the transfer element attracting means is recorded when the transfer element is not attracted on the transfer element attracting means.

In FIG. 2, the ordinate thereof shows the values of the received light signals of the light sensor, while the abscissa thereof shows the time that is required for one rotation of the transfer element attracting means. As shown in FIG. 2, the values of the received light signals in the initial states thereof, which are shown by a dotted line, are stained or deteriorated as the time of use passes while the signal levels thereof are lowered as shown by a solid line. However, the way of lowering is not uniform but it varies depending on the stain, damage, or tie bar (a joint of a transfer film which forms the transfer element carrier) of the surface of the transfer element attracting means, or the like. Further, such variation is accelerated also when the section shape of the transfer element attracting means is shifted from a true circle.

Figure 3:
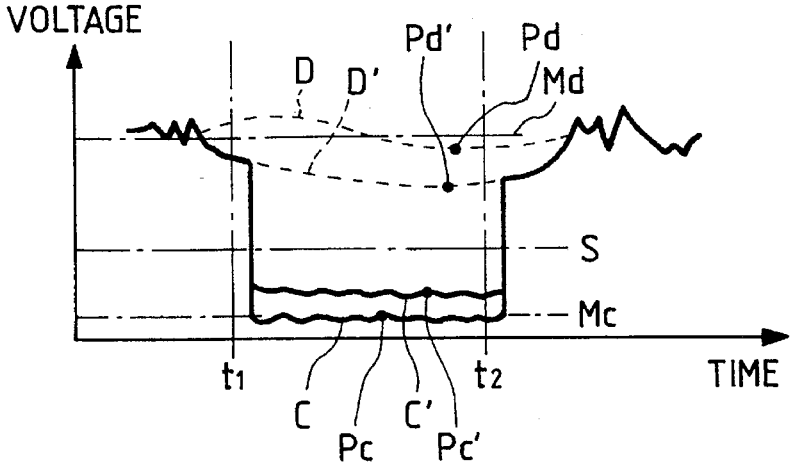
FIG. 3 is a graphical representation of variations in a received light signal obtained when a transfer element is attracted on transfer element attracting means.

Now, in FIG. 3, there is shown an example of a graphical representation of the recorded values of the received light signal levels when the transfer element is attracted onto the transfer element attracting means.

In FIG. 3, similarly to FIG. 2, the ordinate thereof shows the values of the received light signals of the light sensor, while the abscissa thereof shows the time required for one rotation of the transfer element attracting means. In FIG. 3, a curved line D shown by a dotted line expresses the values of the received light signals when the transfer element is not attracted on transfer element attracting means which is newly provided, while a curved line D' represents the values of the received light signals when the transfer element is not attracted on the transfer element attracting means that is deeply deteriorated. Also, both of curved lines C and C' show the value of the received light signals obtained when the transfer element is attracted on the transfer element attracting means and the levels of the received light signals are lowered. And, the difference between the curved lines C and C' depends on the difference between the received light signal levels according to the kinds of the transfer elements, or depends on the received light signal levels due to the stain of the light sensor after use of the transfer element attracting means is started.

As described above, in both of the cases where the transfer element is not attracted on the transfer element attracting means and where the transfer element is attracted on the transfer element attracting means, the received light signal levels in the initial state of the transfer element attracting means are different from those after start of use of the transfer element attracting means.

In view of the above, according to the present embodiment, in order to detect accurately whether the transfer element is attracted on the surface of the transfer element attracting means or not, the optimum threshold value is determined in accordance with all degrees of the stained or deteriorated conditions of the transfer element attracting means.

In other words, at first, in the adjustment stage of the transfer device before start of use thereof, out of the received light signal levels (shown by the curved D) of the light sensor obtained when the transfer element is not attracted on the surface of newly provided transfer element attracting means, the received light signal levels in the area t1–t2 to be detected as to whether a given transfer element is present or not are measured. Secondly, out of the measured values, there is obtained a peak value Pd on the side of the received light signal levels (shown by the curved line C) when the transfer element is attracted on the surface of the transfer element attracting means. Thirdly, a threshold value S is determined in accordance not only with a predetermined reference value Mc of the received light signal levels (shown by the curved line C) when the transfer element is attracted on the surface of the transfer element attracting means but also with the above-obtained peak value Pd. However, the way of determining the threshold value S is not limited to a specific one. For example, an intermediate value between the peak value Pd and the reference value Mc may be determined as the threshold value, or a value which is smaller by a given value than the peak value Pd may be determined as the threshold value. That is, the threshold value S is to be input after it is selected out of the values obtained in both cases where the transfer element is present and where the transfer element is not present, depending on the material of the surface of the transfer element attracting means, the levels of the received light signals, and the like. Based on the threshold value S determined in this manner, it is detected whether the transfer element is attracted on the transfer element attracting means or not. Here, the reference value Mc may be set properly in accordance with static values such as the average value of the received light signal levels (shown by the curved line C) in a standard state where the transfer element is attracted on the surface of the transfer element attracting means, the standard deviation thereof, and the like.

After start of use of the transfer device, when the received light signal level is lowered from the curved line D to the curved line D' due to the stained or deteriorated transfer element attracting means, the threshold value S is updated in the following manner. That is, a peak value Pd' of the curved line D' on the received light signal level (curved line C) when the transfer element is attracted on the surface of the transfer element attracting means is found, and, after then, a threshold value is determined based on the above-mentioned reference value Mc and peak value Pd', and the threshold value S is updated to the thus determined threshold value. Next, in accordance with the new threshold value S, it is detected whether the transfer element is attracted on the transfer element attracting means or not.

The threshold value may be set in a threshold setting auxiliary cycle which is executed prior to an image forming cycle, or may be set periodically in every threshold setting auxiliary cycle according to the accumulated time of use of the transfer device, or the timing of execution of the threshold value setting processing may also be determined automatically or manually according to the degree of stain of the transfer element attracting means or the degree of deterioration thereof due to damage or the like.

Also, in another embodiment, in the transfer element attracting means in the initial condition thereof, out of the received light signal levels (curved line C) of the light sensor when the transfer element is attracted on the transfer element attracting means, the received light signal levels in the area t1–t2 that are used to detect whether a given transfer element is present or not is measured. Next, out of the measured values, there is found a peak value Pc on the side of the received light signal levels (curved line D) when the transfer element is not attracted on the surface of the transfer element attracting means. After then, in accordance not only with a predetermined reference value Md of the received light signal levels when the transfer element is not attracted on the surface of the transfer element attracting means but also with the above-mentioned peak value Pc, the threshold value S is determined. The way of determination of the threshold value S is not limited to a specific one, similarly to the above-mentioned embodiment. Based on the thus determined threshold value S, it is detected whether the transfer element is attracted on the transfer element attracting means or not. Also, the way of setting the reference value Md is similar to the way of setting the above-mentioned reference value Mc. After start of use of the transfer device, when the received light signal levels vary from the curved line C to the curved line C' due to change in the kinds or sizes of the transfer elements or due to the stained light receiving surface of the light sensor or the deteriorated elements thereof, the threshold value S can be updated in the following manner. That is, there is firstly found a peak value Pc' of the curved line C' on the side of the received light signal levels (curved line D) when the transfer element is not attracted on the surface of the transfer element attracting means, next there is determined a threshold value based on the above-mentioned reference value Md and peak value Pc', and the old threshold value is updated to the thus determine threshold value, namely, a new threshold value S. After then, in accordance with the new threshold value S, it is detected whether the transfer element is attracted on the transfer element attracting means or not.

In a further embodiment, in the adjusting operation prior to start of use of the transfer device, out of the received light signal levels (curved line D) of the light sensor when the transfer element is not attracted on the transfer element attracting means, the received light signal levels in the area t1–t2 that are used to detect whether a given transfer element is present or not are measured. Next, u out of the measured values, there is found a peak value pd on the side of the received light signal levels (curved line C) when the transfer element is attracted on the surface of the transfer element attracting means. Then, out of the received light signal levels (curved C) when the transfer element is attracted on the surface of the transfer element attracting means, there are measured the received light signal levels in the area t1–t2 that are used to detect whether a given transfer element is present or not. Next, out of the measured values, there is found a peak value Pc on the side of the received light signal levels (curved line D) when the transfer element is not attracted on the surface of the transfer element attracting means. After then, the threshold value S is determined in accordance with both of the above-mentioned peak values Pd and Pc. The way of determining the threshold value S is similar to the above-mentioned case. In accordance with the thus determined threshold value S, it is detected whether the transfer element is attracted on the transfer element attracting means or not.

After start of use of the transfer device, when the received light signal levels when the transfer element is not attracted on the surface of the transfer element attracting means are varied from the curved line D to the curved line D' due to the stained or deteriorated transfer element attracting means, and also when the received light signal levels when the transfer element is attracted on the surface of the transfer element attracting means are varied from the curved line C to the curved line C' due to the stained light receiving surface of the light sensor or due to the deteriorated elements thereof, the threshold value S is updated in the following manner. That is, there is obtained a peak value Pd' of the curved line D' on the side of the received light signal levels (curved line C') when the transfer element is attracted on the surface of the transfer element attracting means, there is obtained a peak value Pc' of the curved line C' on the side of the received light signal levels (curved line D') when the transfer element is not attracted on the surface of the transfer element attracting means, a threshold value is determined in the above-mentioned manner based on the peak values Pd' and Pc', and the thus determined threshold value is set as a new threshold value S. After then, in accordance with the new threshold value S, it is detected whether the transfer element is attracted on the transfer element attracting means or not.

In the above-mentioned respective embodiments, the area necessary for measuring the received light signal levels of the light sensor does not always coincide with the whole area necessary for one rotation of the transfer element attracting means but it may be an area which is necessary and sufficient to check whether the transfer element is present or not.

Figure 4:
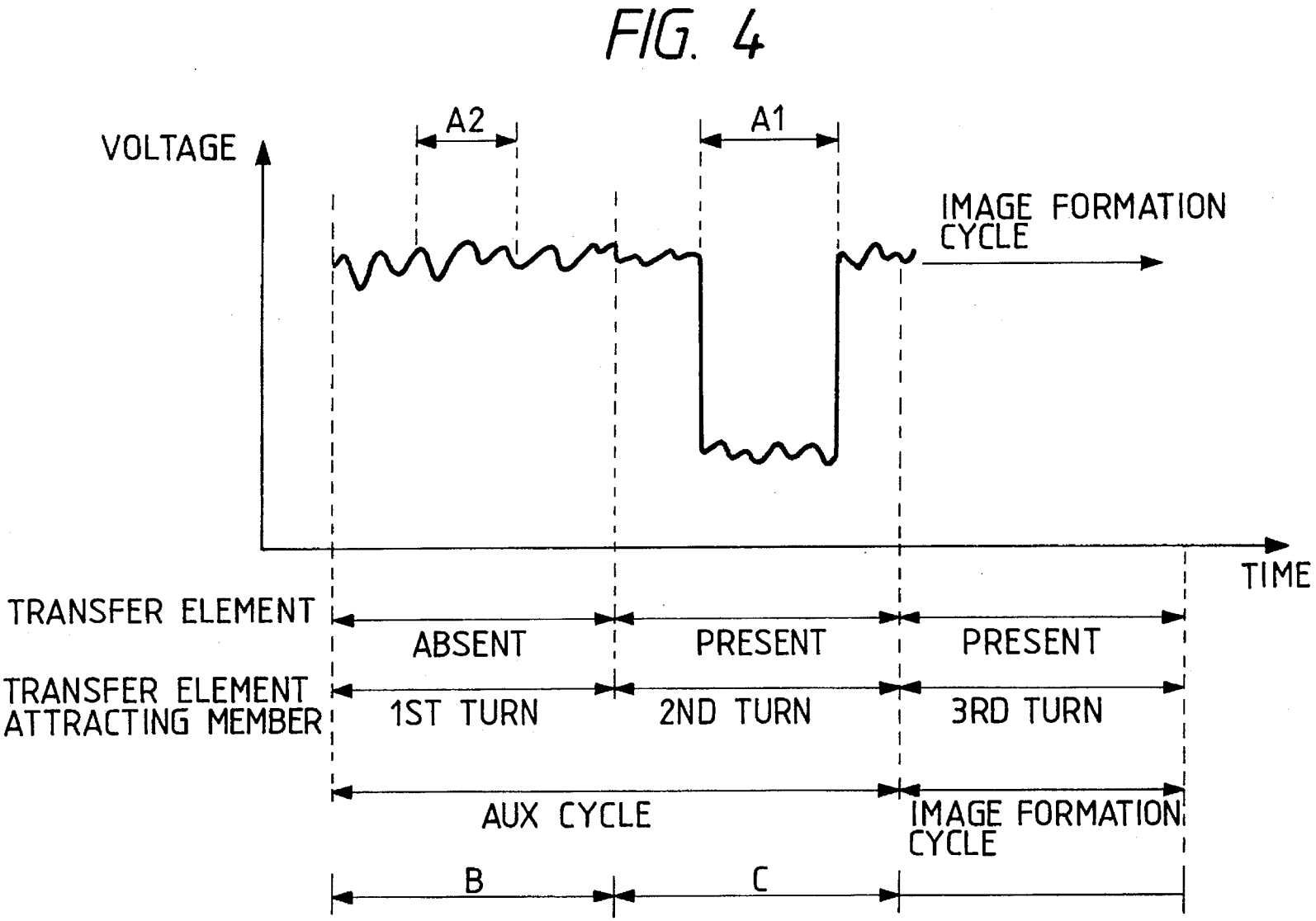
FIG. 4 is an explanatory view, showing how a threshold value is set in the invention.

For example, as shown in FIG. 4, the threshold value setting is carried out periodically according to the accumulated time of use of the transfer device before the image forming cycles: that is, there are provided two auxiliary cycles in which the threshold value is determined, and there are provided image forming cycles which are to be performed continuously with the auxiliary cycles.

In the auxiliary cycles for determination of the threshold value, at first, for the first rotation of the transfer element attracting means, the transfer element attracting means is rotated in a state that the transfer element is not present on the transfer element attracting means and signal levels occurring during this first rotation are obtained (B area). Next, for the second rotation, the transfer element attracting means is rotated in a state that the transfer element is present thereon and signal levels occurring during the second rotation are obtained (C area). And, as described above, the threshold values are to be determined in the respective ways, that is, in the C area, by use Of the signal levels in an area $A_1$ in which the transfer element is present and, in the B area, by use of the signal levels in an area $A_2$. And, on and from the third rotation of the transfer element attracting means, the image forming cycles are actually executed. Due to this, there is eliminated the possibility that the transfer element can be used wastefully.

As has been described heretofore, according to the transfer element detect device of the invention, there can be provided a transfer element detect device which can detect accurately whether a transfer element is present or not, without being influenced by the deterioration of transfer element attracting means and the like due to the stain or damage thereof, the kinds and sizes of the transfer elements used, the stained light receiving surface of a light sensor or the deteriorated elements thereof, and other similar causes.

Also, according to the invention, it is possible to continue using such transfer element attracting means that has been conventionally judged as unusable any longer and thrown out, so that a great economic effect can also be provided.

What is claimed is:

1. A transfer element detect device, comprising:

transfer element attracting means for attracting a transfer element on the surface thereof;

a light sensor for receiving the reflected light or transmitted light of said transfer element attracting means;

threshold value setting means for setting a threshold value between the average value of the received light signal levels of said light sensor in the same area of the surface of said transfer element attracting means when a transfer element is attracted on the surface of said transfer element attracting means and a peak value on the side of said average value when the transfer element is not attracted thereon, and for setting a threshold value according to said peak value;

means for storing said threshold value; and, detect means for detecting the passage of the transfer element on the surface of said transfer element attracting means based on a comparison between said stored threshold value and signal level of the light received from said transfer element attracting means.

2. A transfer element detect device as claimed in claim 1, wherein said threshold value setting means enforces the setting of said threshold value prior to an image forming cycle.

3. A transfer element detect device as claimed in claim 1, wherein said threshold value setting means enforces the setting of said threshold value periodically according to the accumulated time of use of a transfer device.

4. A transfer element detect device, comprising:

transfer element attracting means for attracting a transfer element on the surface thereof;

a light sensor for receiving the reflected light or transmitted light of said transfer element attracting means;

threshold value setting means for setting a threshold value between the average value of the received light signal levels of said light sensor in the same area of the surface of said transfer element attracting means when a transfer element is not attracted on the surface of said transfer element attracting means and a peak value on the side of said average value when the transfer element is attracted thereon, and for setting a threshold value according to said peak value;

means for storing said threshold value; and, detect means for detecting the passage of the transfer element on the surface of said transfer element attracting means based on a comparison between said stored threshold value and the signal level of the light received from said transfer element attracting means.

5. A transfer element detect device as claimed in claim 4, wherein said threshold value setting means enforces the setting of said threshold value prior to an image forming cycle.

6. A transfer element detect device as claimed in claim 4, wherein said threshold value setting means enforces the setting of said threshold value periodically according to the accumulated time of use of a transfer device.

7. A transfer element detect device, comprising:

transfer element attracting means for attracting a transfer element on the surface thereof;

a light sensor for receiving the reflected light or transfer light of said transfer element attracting means;

threshold value setting means for setting a threshold value between a first peak value of the received light signal levels of said light sensor in the same area of the surface of said transfer element attracting means when a transfer element is not attracted on the surface of said transfer element attracting means and a second peak value when the transfer element is attracted thereon, when said two peak values are the nearest to each other;

means for storing said threshold value; and, detect means for detecting the passage of the transfer element on the surface of said transfer element attracting means based on a comparison between said stored threshold value and the signal level of the light received from said transfer element attracting means.

8. A transfer element detect device as claimed in claim 7, wherein said threshold value setting means enforces the setting of said threshold value prior to an image forming cycle.

9. A transfer element detect device as claimed in claim 7, wherein said threshold value setting means enforces the setting of said threshold value periodically according to the accumulated time of use of a transfer device.

* * * * *